US006474310B2

(12) United States Patent
Joos et al.

(10) Patent No.: US 6,474,310 B2
(45) Date of Patent: Nov. 5, 2002

(54) FUEL SUPPLY DEVICE FOR AN INTERNAL COMBUSTION ENGINE OF A MOTOR VEHICLE

(75) Inventors: Klaus Joos, Walheim (DE); Jens Wolber, Gerlingen (DE); Thomas Frenz, Noerdlingen (DE); Markus Amler, Leonberg-Gebersheim (DE); Hansjoerg Bochum, Novi, MI (US)

(73) Assignee: Robert Bosch GmbH, Stuttgart (DE)

( * ) Notice: Subject to any disclaimer, the term of this patent is extended or adjusted under 35 U.S.C. 154(b) by 12 days.

(21) Appl. No.: 09/782,487

(22) Filed: Feb. 13, 2001

(65) Prior Publication Data

US 2001/0018908 A1 Sep. 6, 2001

(30) Foreign Application Priority Data

Feb. 15, 2000 (DE) ..... 100 06 622

(51) Int. Cl.[7] ..... F02M 37/10
(52) U.S. Cl. ..... 123/497; 123/514
(58) Field of Search ..... 123/458, 497, 123/510, 514

(56) References Cited

U.S. PATENT DOCUMENTS 5,044,344 A * 9/1991 Tuckey et al. ..... 123/497
5,148,792 A * 9/1992 Tuckey ..... 123/497
5,197,444 A 3/1993 Lang et al. ..... 123/514
5,692,479 A * 12/1997 Ford et al. ..... 123/514
5,785,025 A 7/1998 Yoshiume et al. ..... 123/497
5,878,718 A 3/1999 Rembold et al. ..... 123/456

FOREIGN PATENT DOCUMENTS

DE 28 08 731 C2 9/1987
DE 44 43 836 A1 6/1996
JP 10-299600 11/1998

* cited by examiner

*Primary Examiner*—Tony M. Argenbright
(74) *Attorney, Agent, or Firm*—Michael J. Striker

(57) ABSTRACT

A fuel supply device for an internal combustion engine of a motor vehicle has a supply container, a feeding aggregate which is electric-motor driven and feeds fuel from the supply container to an injection device of the internal combustion engine, a pressure sensor which determines a fuel pressure downstream of the feeding aggregate, a control device connected with the pressure sensor and controlling an operation of the feeding aggregate so that a fuel pressure is at least approximately below a nominal pressure, a throttled discharge arranged downstream of the feeding aggregate, a valve device operative for controlling the discharge depending on a fuel pressure and opening the discharge when a fuel pressure located under the nominal pressure is exceeded, and a check valve integrated in the feeding aggregate.

5 Claims, 1 Drawing Sheet

FUEL SUPPLY DEVICE FOR AN INTERNAL COMBUSTION ENGINE OF A MOTOR VEHICLE

BACKGROUND OF THE INVENTION

The present invention relates to a fuel supply device for an internal combustion engine of a motor vehicle.

One of such fuel supply devices is disclosed for example in the German patent document DE28 08 731 C2. The fuel supply device has a feeding aggregate which is driven by an electric motor and feeds the fuel from a supply container to an injection device of the internal combustion engine. Moreover, a pressure sensor is provided which determines the fuel pressure downstream of the feeding aggregate. The pressure sensor is connected with a control device which controls the operation of the electric motor of the feeding aggregate, so that the fuel pressure downstream of the feeding aggregate is at least approximately equal to a predetermined nominal pressure. The feeding aggregate therefore feeds only the fuel quantity which is consumed by the internal combustion engine, so that no return quantity is supplied back from the internal combustion engine to the supply container. A throttled discharge is provided downtream of the pressure sensor so that during the operation of the feeding aggregate, a partial quantity of the fuel fed by it is discharged. This enables an operation of the feeding aggregate also when the fuel consumption of the internal combustion engine is very small. In particular, during and after the start of the internal combustion engine, the feeding aggregate does not provide the full feeding power, and a partial quantity of the fuel fed by the feeding aggregate is discharged through the throttle discharge so that in this condition the fuel quantity supplied by the internal combustion engine is not sufficient. Moreover, due to the throttled discharge with the switched off internal combustion engine, fuel is discharged so that the fuel pressure in the injection device of the internal combustion engine is decreased.

SUMMARY OF THE INVENTION

Accordingly, it is an object of present invention to provide a fuel supply device for an internal combustion engine of a motor vehicle which avoids the disadvantages of the prior art.

In keeping with these objects and with others and with others which will become apparent hereinafter, one feature of present invention resides, briefly stated, in a fuel supply device of the above mentioned general type, in which the discharge is controlled by a valve device in dependence on the fuel pressure, and the valve device opens the discharge in response to exceeding a fuel pressure located under the nominal pressure, and also a check valve is integrated in the feeding aggregate.

When the fuel supply device is designed in accordance with the present invention, it has the advantage that the throttle discharge is first open by the valve device when the fuel pressure reaches at least approximately the predetermined nominal pressure, so that in particular at and after the start the total fuel quantity fed by the feeding aggregate is supplied, to the internal combustion engine. Moreover, the valve device guarantees that with the shut off internal combustion engine, the throttled discharge is closed and the fuel pressure in the injection device is maintained at least approximately at the predetermined nominal pressure. When a pressure increase occurs with the shut-off internal combustion engine due to a heating of the fuel, it can be unloaded due to the valve device.

In accordance with another advantageous feature of present invention, a fuel filter is arranged between the feeding aggregate and the pressure sensor, so that the pressure sensor determines the fuel pressure downstream of the fuel filter. In this construction the pressure sensor determines the actual fuel pressure in the injection device which, for example due to a dirtying of the fuel filter, can be lower than the fuel pressure upstream of the fuel filter.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
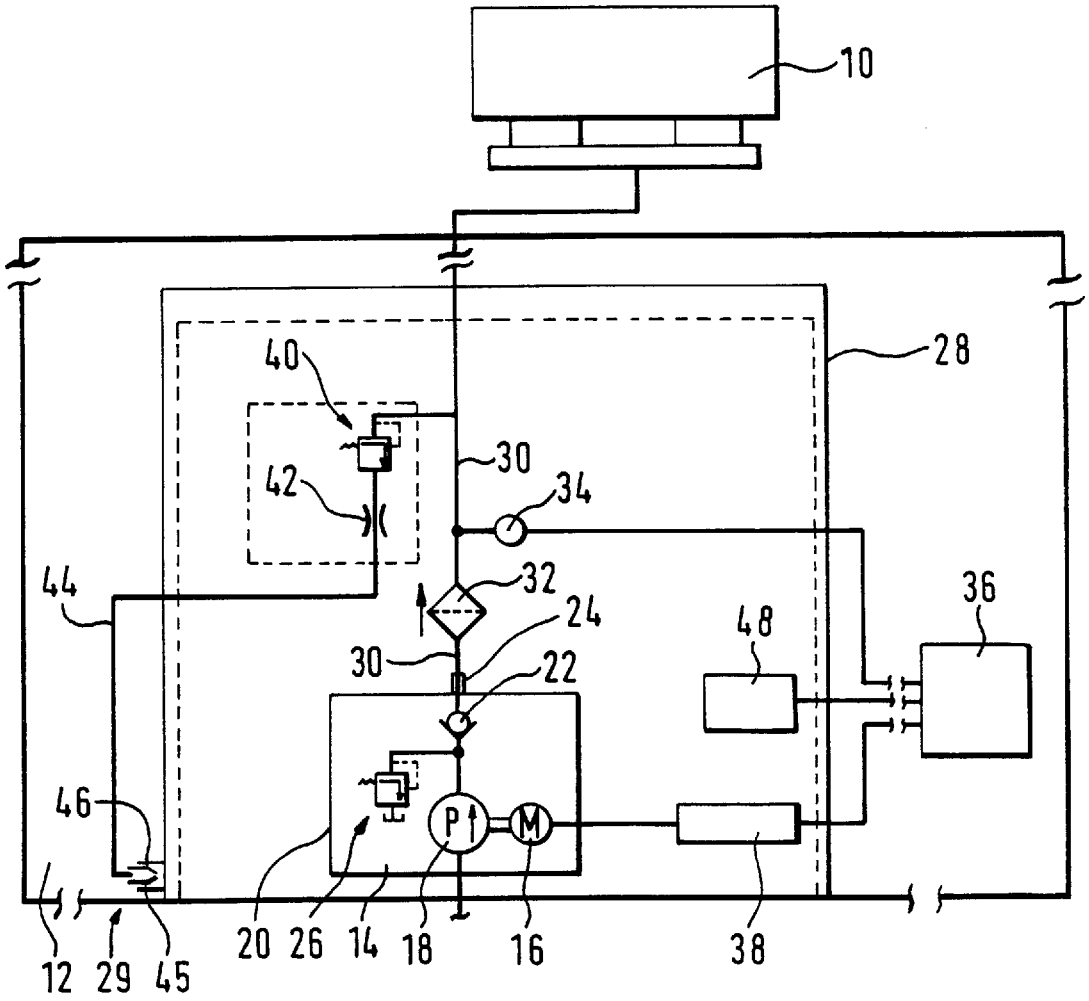
FIG. 1 is a view schematically showing a fuel supply device for an internal combustion engine of a motor vehicle, in accordance with the present invention.

The fuel supply device in accordance with the present invention is used for supplying fuel to an internal combustion engine 10 of a motor vehicle. The internal combustion engine 10 has an injection device, which injects the fuel into the cylinder of the internal combustion engine. The motor vehicle has a fuel supply container 12 with a fuel supply device accommodated in the container.

The fuel supply device has a filling aggregate 14 with a drive provided by an electric motor 16. The electric motor 16 drives a pump part 18. The electric motor 16 and the pump part 18 are arranged in a joint housing 20. A check valve 22 is integrated in the feeding aggregate 14. It can be arranged for example in a pressure pipe 24 which leads from the housing 20. The check valve 22 opens in a feeding direction of the feeding aggregate 14 to the internal combustion engine and closes in an opposite direction, so that no fuel can flow back from the internal combustion engine 10 into the feeding aggregate 14.

A pressure limiting valve 26 is integrated in the feeding aggregate 14 and arranged upstream of the check valve 22. The pressure limiting valve 26 is adjusted to an opening pressure which is substantially higher than the conventional fuel pressure which occurs during correct operation of the components of the fuel supply device downstream of the feeding aggregate 14. When due to disturbances, such as for example a clogging or bending of the conduits, the fuel pressure significantly increases, the pressure limiting valve 26 opens and allows a return flow of the fuel fed by the feeding aggregate 14 back into the fuel container 12. Thereby a damage to the feeding aggregate 14 or the conduit 30 is avoided. The pressure limiting valve 26 can be for example adjusted to an opening pressure between 6 and 8 bar.

The feeding aggregate 14 is arranged preferably in a storage container 28. The storage container is inserted in the supply container 12 and has a substantially smaller volume than the supply container 12. Fuel is fed from the supply container 12 into the storage container 28, for example by a suction jet pump 29. The fuel container 12 can be provided with a plurality of chambers which are separated from one another. Fuel can be fed from one chamber or several chambers of the supply container 12 into the chamber, in which the feeding aggregate 14 is located.

A conduit 30 leads from the pressure side of the feeding aggregate 14 to an internal combustion engine 10. A fuel filter 32 is arranged in the conduit 30. A pressure sensor 34 is located in the conduit 30 downstream of the fuel filter 32. It determines the fuel pressure in the conduit 30 downstream of the fuel filter. The pressure sensor 34 is connected with an electronic control device 36, which processes the signals of the pressure sensor 34 as will be explained herein below. The pressure sensor 34 determines the actual fuel pressure which acts in the injection device of the internal combustion engine 10. This actual pressure can be lower than the fuel pressure downstream of the fuel filter 32, because of dirtying of the fuel filter 32.

The control device 36 evaluates the fuel pressure in the conduit 30 and compares it with a predetermined nominal pressure. The nominal pressure can be constant. On the other hand, it can be variable, depending for example on operational parameters of the internal combustion engine. The control device 36 regulates moreover the operation of the electric motor 16 of the feeding aggregate 14, so that a fuel quantity supplied by the feeding aggregate 14 and required for producing a fuel pressure detected by the pressure sensor 34 in the conduit 30 downstream of the fuel filter 32, is at least approximately equal to the predetermined nominal pressure. The control device 36 preferably times the voltage and/or current supply of the electric motor 16 of the feeding aggregate 14, and a timing module 38 is provided for this purpose. The timing module 38 can change the effective value of the voltage at the electric motor 16 and/or the current supplied by the electric motor 16, by a variation of a timing ratio, so that the feeding quantity required for obtaining the nominal pressure is made available by the feeding aggregate 14. The frequency with which the electric motor 16 is operated in a time fashion, is preferably above an audible region of substantially 20 kHz.

A valve device 40 is arranged downstream of the pressure sensor 34 for controlling a throttled discharged 42. The valve device 40 can be arranged also upstream of the pressure sensor 34. The valve device 40 is a pressure limiting valve, which controls the discharge depending on the fuel pressure in the conduit 30 downstream of the pressure sensor 34. The valve device 30 is adjusted so that, it opens with the fuel pressure in the conduit 30 which is somewhat smaller than the nominal pressure, which is adjusted by the control device 36 by the correspondingly controlled operation of the feeding aggregate 14. The opening pressure of the valve device 40 can be for example 80%–95% of the nominal pressure. When the nominal pressure amounts for example to substantially 3 bar, the opening pressure of the valve device 40 can be 2.8 bar. When the nominal pressure is variable, the opening pressure of the valve device 40 is adjusted so that it is located substantially under the lowest predetermined nominal pressure.

During starting of the internal combustion engine 10, a greater fuel consumption takes place, and the feeding aggregate 14, depending on voltage of the board system of the motor vehicle, under certain conditions does not reach the full feeding power. When the fuel pressure in the conduit 30 does not reach the nominal pressure, the electric motor 16 of the feeding aggregate 14 is operated through the control device 36 with the full voltage.

As long as the fuel pressure is substantially under the nominal pressure, the throttle discharge 32 remains closed by the valve device 40, so that the total fuel quantity which is fed from the feeding aggregate 14 reaches the internal combustion engine. When the fuel pressure reaches approximately the predetermined nominal pressure, the valve device 32 opens the throttled discharge 42. When the fuel pressure during the operation of the feeding aggregate 14 reaches the nominal pressure, the discharge 42 remains continuously open by the valve device, so that the fuel discharges through the discharge 42.

The throttled discharge 42 is designed so that a sufficiently great fuel quantity is discharged through it. Preferably it is provided that the suction jet pump 29 is connected to the discharge 42, so that the fuel quantity which is discharged through the discharge 42 provides the driving quantity before the suction jet pump 29. The suction jet pump 29 is connected with the discharge 42 through a conduit 44 and, in a known manner, has a nozzle 45 for issuing of the driving jet. It also has an opening 46 located after the nozzle 45, through which the additional fuel enters from the fuel container 12 and is fed into the storage container 28. The discharge 42 is designed so that, the driving quantity reaches the suction jet pump 29 to guarantee a filling of the storage container 28. Also, two or more suction jet pumps 29 can be connected to the discharge 42.

The valve device 40 also guarantees that with the shut off internal combustion engine 10 and not operating feeding aggregate 14, the discharge is closed. Therefore in the injection device of the internal combustion engine 10 a sufficient fuel pressure is maintained. Moreover, the valve device 40 performs a safety function. The fuel pressure in the injection device of the internal combustion 10 is limited, since in the case of exceeding of the opening pressure, the valve device 40 opens the discharge. An increase of the fuel pressure can occur for example in a thrust operation of the internal combustion engine in which no fuel is consumed, or during warming of fuel after the shutting off of the internal combustion engine 10.

The storage container 28 with the feeding aggregate 14 arranged in it, the fuel filter 32, the pressure sensor 34, the valve device 40 with the discharge 42, and also the timing module 38 are assembled for example to form a structural assembly. It can be assembled outside of the supply container 12 and introduced as a single assembly into the supply container. The assembly can be also provided with a filling level indicator 48 for the filling level of the supply container 12. With this construction the mounting and wiring expenses of the components of the assembly are maintained at a low level. Moreover, it is advantageous than due to the arrangement of the pressure sensor 34 in the assembly with the feeding aggregate 14, a close coupling of the adjusting member and the regulating path is obtained, which is favorable for the stability of the regulation.

It will be understood that each of the elements described above, or two or more together, may also find a useful application in other types of constructions differing from the types described above.

While the invention has been illustrated and described as embodied in fuel supply device for an internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A fuel supply device for an internal combustion engine of a motor vehicle, comprising a supply container; a feeding aggregate which is electric-motor driven and feeds fuel from said supply container to an injection device of the internal combustion engine; a pressure sensor which determines a fuel pressure downstream of said feeding aggregate; a control device connected with said pressure sensor and controlling an operation of said feeding aggregate so that a fuel pressure is at least approximately below a nominal pressure; a throttled discharge arranged downstream of said feeding aggregate; a valve device operative for controlling said discharge depending on a fuel pressure and opening said discharge when a fuel pressure located under the nominal pressure is exceeded; and a check valve integrated in said feeding aggregate.

2. A fuel supply device as defined in claim 1, wherein said valve device is formed so that it opens said discharge in response to exceeding of substantially 80%–90% of the nominal pressure.

3. A fuel supply device as defined in claim 1; and further comprising a fuel filter which is arranged between said feeding aggregate and said pressure sensor, so that said pressure sensor determines the fuel pressure downstream of said fuel filter.

4. A fuel supply device as defined in claim 1; and further comprising a pressure limiting valve integrated in said feeding aggregate upstream of said check valve.

5. A fuel supply device as defined in claim 1; and further comprising a storage container from which said feeding aggregate aspirates the fuel, and at least one suction jet pump which is connected to said discharge and is operative for at least one feeding of the fuel selected from the group consisting of feeding of the fuel between different chambers of said supply container and feeding of the fuel from said supply container into said storage container.

* * * * *